United States Patent [19]

Sieghartner

[11] Patent Number: 4,479,756

[45] Date of Patent: Oct. 30, 1984

[54] MULTI-STAGE PUMP

[75] Inventor: Leonard J. Sieghartner, Coal Valley, Ill.

[73] Assignee: Roy E. Roth Company, Rock Island, Ill.

[21] Appl. No.: 458,662

[22] Filed: Jan. 17, 1983

Related U.S. Application Data

[63] Continuation of Ser. No. 155,779, Jun. 2, 1980, abandoned, which is a continuation of Ser. No. 935,604, Aug. 21, 1978, abandoned.

[51] Int. Cl.[3] ..... F04D 11/00

[52] U.S. Cl. ..... 415/53 T; 415/213 T; 415/199.5

[58] Field of Search ..... 415/199.1, 199.5, 199.6, 415/198.2, 143, 102, 103, 213 T, DIG. 3, 53 T

[56] References Cited

U.S. PATENT DOCUMENTS

| | | | |
|---|---|---|---|
| 3,250,458 | 5/1966 | Caldwell | 415/102 |
| 3,408,045 | 10/1968 | Hart | 415/103 |
| 3,614,256 | 10/1971 | Sieghartner | 415/113 |
| 3,759,626 | 9/1973 | Becker | 415/199.5 |
| 3,963,371 | 6/1976 | Sieghartner | 415/198.2 |

FOREIGN PATENT DOCUMENTS

| | | | |
|---|---|---|---|
| 969286 | 5/1958 | Fed. Rep. of Germany | 415/213 T |

*Primary Examiner*—Henry C. Yuen
*Assistant Examiner*—John Kwon
*Attorney, Agent, or Firm*—Emrich & Dithmar

[57] ABSTRACT

A multi-stage pump embodying a casing having two elongated end sections disposed on opposite sides of an intermediate discharge section and secured thereto, the end sections being of modular construction and embodying a plurality of axially aligned casing rings having impellers rotatably mounted therein, the casing rings being removably mounted relative to each other and, together with the impellers disposed therein, each comprising a respective stage for the pump, the end sections of the casing each having a passageway, including the interiors of the casing rings, for feeding liquid inwardly through the outer ends of the end sections of the casing and discharging the liquid into the aforementioned intermediate discharge section for discharge from the pump, during rotation of the impellers.

10 Claims, 2 Drawing Figures

MULTI-STAGE PUMP

This is a continuation, of application Ser. No. 155,779, filed June 2, 1980, abandoned, which in turn is a continuation of pending U.S. Ser. No. 935,604 filed Aug. 21, 1978 abandoned.

BACKGROUND OF THE INVENTION

This invention relates to multi-stage pumps, and, more particularly, to multi-stage pumps of the double-suction type.

It is a primary object of the present invention to afford a novel multi-stage pump.

Another object of the present invention is to afford a novel multi-stage pump of the double-suction type, that is, a pump having two inlet openings from which liquid is fed into a common discharge opening.

A further object of the present invention is to afford a novel pump having substantially double the capacity of a pump of the one end suction-one end discharge type, without increasing the size of the liners, casings or impellers, thereof.

Another object of the present invention is to afford a novel multi-stage pump of the double-suction type which is effective to pump liquids, such as, for example, liquified gases, at or near the boiling points thereof, as well as being effective to pump other liquids, such as, for example, water.

Multi-stage pumps for pumping liquids, at or near the boiling points thereof, have been heretofore known in the art, being shown, for example, in U.S. Pat. No. 2,875,968, issued to L. C. Roth, on Mar. 3, 1959, and my earlier U.S. Pat. No. 3,963,371, issued on June 15, 1976. Such pumps have been highly successful. It is an important object of the present invention to afford improvements over the multi-stage pumps heretofore known in the art.

Another object of the present invention is to afford a novel multi-stage pump, of the double-suction type, wherein liquid enters through oppositely disposed ends of the pump and is discharged through a common, centrally located discharge passageway.

Yet another object of the present invention is to afford a novel double-suction, multi-stage pump of the aforementioned type which is modular in construction, and is constructed in such a manner that the various stages hereof may be readily assembled and separated, relative to each other.

A further object of the present invention is to afford a novel double-suction, multi-stage pump, having the aforementioned modular construction, which is of a combination centrifugal-turbine type.

Another object of the present invention is to afford a novel double-suction, multi-stage pump of the aforementioned type which is practical and efficient in operation, and which may be readily and economically produced commercially.

Other and further objects of the present invention will be apparent from the following description and claims and are illustrated in the accompanying drawings which, by way of illustration, show the preferred embodiment of the present invention and the principles thereof and what I now consider to be the best mode which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT DISCLOSED HEREIN

Figure 1:
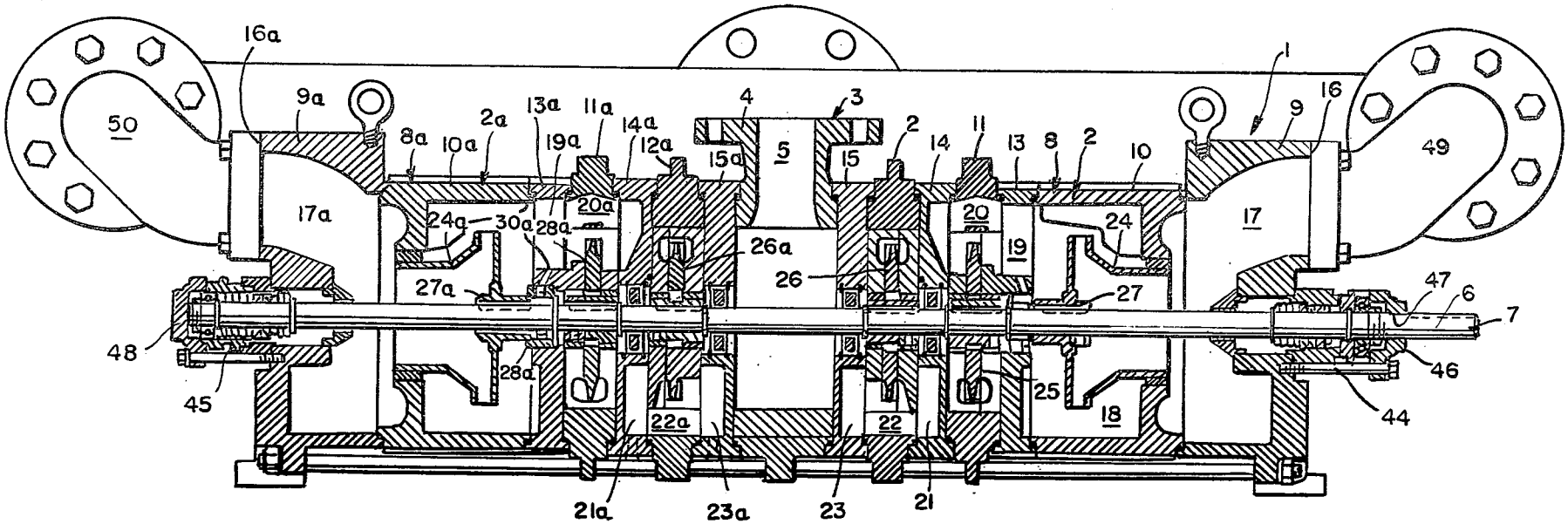
FIG. 1 is a longitudinal sectional view through a double-suction, multi-stage pump embodying the principles of the present invention.

A pump 1, embodying the principles of the present invention, is shown in the drawings to illustrate the presently preferred embodiment of the present invention.

The pump 1 embodies two elongated end sections 2 and 2*a* disposed in longitudinal alignment with each other and separated from each other by a central or intermediate section 3, in the form of a discharge casing ring 4 having a discharge or outlet passageway 5 therein, FIG. 1. The two end sections 2 and 2*a* are identical in construction to each other, except that they are mirror images to each other, and except that the drive shaft 6, which is common to both of the end sections 2 and 2*a*, has an end 7, which projects outwardly from the end section 2 for connection to a source of power, such as a suitable prime mover, not shown, for rotatably driving the drive shaft 6.

Figure 2:
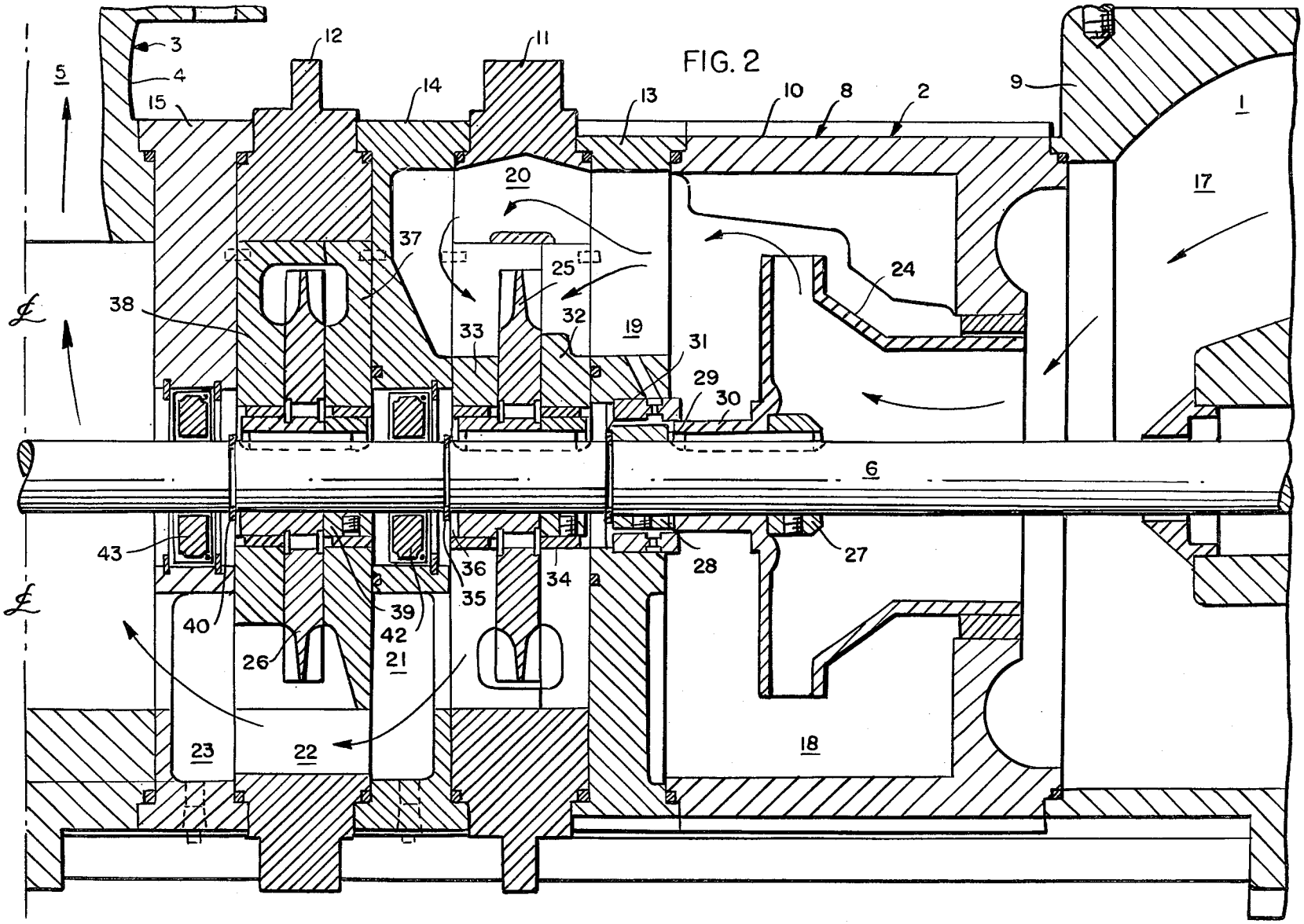
FIG. 2 is an enlarged, detail, longitudinal sectional view through one end portion of the pump shown in FIG. 1.

The end section 2 of the pump 1 includes an elongated casing section 8, FIGS. 1 and 2, which embodies an inlet casing ring 9, another casing ring 10, disposed in abutting, sealed relation to the inner side of the casing ring 9, and two other casing rings 11 and 12 disposed in spaced relation to the casing ring 10 and to each other; and an annular transfer plate 13 disposed between the casing rings 10 and 11 in sealed relation thereto, a second annular transfer plate 14 disposed between the casing rings 11 and 12 in sealed relation thereto, and a third annular transfer ring 15 disposed between the casing ring 12, of the casing section 8, and the adjacent discharge casing ring 4 in sealed relation thereto. The casing rings 4 and 9–12 and the transfer plates 13–15 are disposed in axially aligned relation to each other, and may be secured together by any suitable means, not shown, such as, for example, by bolts, as shown in my aforementioned U.S. Pat. No. 3,963,371.

The inlet casing ring 9 has an outer longitudinal end 16, with an inlet passageway 17 opening outwardly through the end 16 and extending inwardly therefrom to afford the inlet portion of a passageway which extends longitudinally through the section 2 of the pump 1, and is composed of the aforementioned passageway 17 through the casing ring 9, a passageway 18 through the casing ring 10, a passageway 19 through the transfer ring 13, a passageway 20 through the casing ring 11, a passageway 21 through the transfer ring 14, a passageway 22 through the casing ring 12, and a passageway 23 through the transfer ring 15, FIG. 2. The passageway 23, at the end thereof remote from the passageway 22, opens into the discharge outlet or passageway 5 in the casing ring 4 of the intermediate section 3 of the pump 1, FIG. 2. During operation of the pump 1, liquid, such as the aforementioned liquified gas or water, or the like, is fed through the passageway 17–23, into the discharge passageway 5 by a centrifugal impeller 24, mounted in the casing ring 10; a turbine impeller, mounted in the casing ring 11; and another turbine impeller 26 mounted in the casing ring 12, as will be discussed in greater detail presently.

The impellers 24–26 may be secured to the drive shaft 6 for rotation therewith in any suitable manner, but in the presently preferred form of the present invention preferably are keyed to the drive shaft 6 and secured thereon in the manner shown in FIG. 2, wherein the impeller 24 is secured between two lock collars 27 and 28, with a wavey spring washer 29 disposed between the lock collar 28 and the adjacent end of the hub 30 of the impeller 24, and with the inner face of the lock collar 28 disposed in abutting engagement with a locating snap-ring 31; the impeller 25 held between two generally annular liners 32 and 33 by a lock collar 34 and a snap-ring 35, with a wavey spring washer 36 disposed between the impeller 25 and the snap-ring 35; and the impeller 26 secured between two generally annular liners 37 and 38 by a lock collar 39 and a snap-ring 40, with a spring washer 41 disposed between the impeller 26 and the snap-ring 40. Seals 42 and 43, which may be of any suitable type, but, preferably, are of the type disclosed in my co-pending application for U.S. Letters Pat. Ser. No. 931,499, filed Aug. 7, 1978 and now issued as U.S. Pat. No. 4,173,350 are disposed around the shaft 6 within the transfer plates 14 and 15, respectively, for preventing or detering leakage of liquid axially of the shaft 6 through the transfer plates 14 and 15.

It is to be remembered that the pump 1 is intended to be adapted to pump liquids, such as, for example, liquified gases, at or near the boiling points thereof, as well as other liquids, such as, for example, water. To this end, the first stage of the multi-stage pump 1 or the preferred form of the present invention is a low pressure booster stage, embodying the centrifugal impeller 24 mounted in the casing ring 10, which, in operation, effectively lowers the low "net positive suction head" (N.P.S.H.) rating of section 2 of the pump in a manner similar to the centrifugal-impeller stage of the pump shown in my earlier U.S. Pat. No. 3,614,256. In the operation of the section 2 of the pump 1, the liquid enters the inlet entrance 17 and enters the centrifugal impeller 24 in the passageway 18 in the casing ring 10 and is discharged from the periphery of the impeller 24 through the passageway 19 in the transfer plate 13 into the passageway 20 of the casing ring 11 of the adjacent turbine stage, or second stage. The regenerative pumping action of the turbine impeller 25 builds up sufficient pressure to deliver the liquid through the passageway 21 in the transfer plate 14 into the passageway 22 in the casing ring 12 of the next adjacent turbine stage, or third stage. The regenerative pumping action of the turbine impeller 26 in the casing ring 12 builds up sufficient pressure to deliver the liquid through the passageway 23 in the transfer plate 15 into and through the discharge outlet 5 in the discharge casing ring 4, from which it is discharged outwardly from the pump 1. Preferably, each stage of the pump section 2 is balanced radially against its adjacent stage by placing the discharges of the successive stages at equal intervals around the shaft 6. It will be seen that, with this construction and mode of operation, the pump section 2 is effective to pump various liquids (whether they be in the form of liquified gases or in the form of water, or the like) from the inlet opening in the end 16 of the casing ring 9 through the passageway 17–23 in the casing section 8 and into and outwardly through the discharge passageway 5 in the discharge casing ring 4 of the intermediate section 3 of the pump 1.

The above described parts of the pump section 2 are identical in construction and mode of operation to corresponding parts in pump section **2*a*, except that they are mirror images thereof, and parts in pump section 2*a* which are the same as parts in pump section 2 are indicated by the same reference numerals with the suffix "a" added thereto. The one exception to the parts in pump sections 2 and 2*a* being identical to each other are the bearing assemblies 44 and 45 of the pump sections 2 and 2*a*, respectively, in which the drive shaft is rotatably mounted, and even these bearing assemblies 44 and 45 are preferably identical in construction, except that the end cap 46 of the bearing assembly 44 has an opening 47 therethrough, through which the drive shaft 6 projects for connection to a suitable prime mover, not shown, and the end cap 48 of the bearing assembly 45 is closed. The bearing assemblies 44 and 45** may be of any suitable construction, but preferably are of the same construction as the bearing assemblies shown in my aforementioned U.S. Pat. No. 3,963,371.

In the operation of the pump section **2*a*, liquid is fed from the inlet opening in the end 16*a* of the casing ring 19*a* through the passageway 17*a*–23*a* into and outwardly through the discharge passageway 5 in the discharge casing ring 4 of the intermediate section 3 of the pump 1 in the same manner as that described with respect to the feeding of liquid through the passageway 17–23 in the pump section 2 and outwardly through the discharge passageway 5 in the discharge casing ring 4. In this operation, liquid is fed inwardly through the inlet opening 16*a* and the passageway 17*a* in the casing ring 9*a* into the passageway 18*a* in the casing ring 10*a*, from which it is discharged by the impeller 24*a* through the passageway 19*a* in the transfer plate 13*a* into the passageway 20*a* in the casing ring 11*a*; is then fed by the impeller 25*a* through the passageway 21*a* in the transfer ring 14*a* into the passageway 22*a* in the casing ring 12*a*; and is then fed by the impeller 26*a* in the casing ring 12*a* through the passageway 23*a* in the transfer ring 15*a* into and outwardly through the passageway 5 in the discharge casing ring 4 of the intermediate section 3 of the pump 1**.

From the foregoing, it will be seen that the casing rings 10–12 and **10*a*–12*a*, together with the parts operatively mounted therein afford individual, respective stages in the pump 1. Thus, the casing rings 10 and 10*a*, together with the impellers 24 and 24*a* mounted therein, respectively, each affords an individual, self-contained booster stage; and the casing rings 11, 12, 11*a* and 12*a*, together with the impellers 25, 26, 25*a* and 26*a*** mounted therein, respectively, each affords an individual, self-contained regenerative turbine stage.

Also it will be seen that the corresponding stages in the oppositely disposed pump sections 2 and **2*a*** are identical in construction so that the same identical parts may be used therein.

In addition, it will be seen that the pump 1 is of a modular-type of construction so that individual portions thereof, including complete stages may be readily removed and replaced or may be added to or eliminated from the pump 1. Thus, pumps having a greater or lesser number of stages than those shown in the drawings hereof may be produced without departing from the purview of the broader aspects of the present invention.

As will be appreciated by those skilled in the art, although the pump 1 is shown herein as embodying centrifugal impellers 24 and 24*a*, this is merely by way of illustration of the preferred form of the present invention and not by way of limitation, and where, for example, no low N.P.S.H. booster is needed, the centrifugal impellers 24 and 24*a* may be eliminated, such as, for example, by mounting the inlet casing rings 9 and 9*a* directly against the casing rings 11 and 11*a*, respectively, without departing from the purview of the broader aspects of the present invention.

If desired, a manifold, only two end portions 49 and 50 of which are shown in FIG. 1, may be connected to the pump 1, with the end portion 49 operatively connected to the end 16 of the casing ring 9, in communication with the inlet passageway 17, and with the end portion 50 operatively connected to the end 16*a* of the casing ring 9*a*, in communication with the inlet passageway 17*a*, for feeding the aforementioned liquid into both ends of the pump 1 from a common source, not shown.

When a single manifold is so used to feed both ends of the pump 1, it is often possible to use a manifold having a main feed line thereinto which is less than twice the size of the two inlet openings into the pump 1. For example, in many instances, a manifold, having a main feed line in the form of a pipe having a six inch diameter may be used to feed liquid into the two passageways 17 and 17*a* of the pump 1, wherein the inlet opening into the passageways 17 and 17*a* is four inches in diameter. This, of course, affords a saving in fittings, such as valves, and the like, the cost of such fittings for four inch pipes being substantially less than those for six inch pipes.

However, as will be appreciated by those skilled in the art, the reference to a manifold is merely by way of illustration and not by way of limitation, and the liquid may be fed into the passageways 17–23 and the passageways 17*a*–23*a* from respective individual sources without departing from the purview of the broader aspects of the present invention.

From the foregoing it will be seen that the present invention affords a novel multi-stage pump which has a capacity that is substantially double that of pumps of the one end suction-one end discharge type.

Also, it will be seen that the present invention affords a novel double-suction pump of the aforementioned type which has a novel modular construction, which enables the identical parts to be used in the two pump sections for affording the various corresponding, respective stages of the pump.

In addition, it will be seen that the present invention affords a novel pump of the aforementioned type wherein the bearings in the bearing housings 44 and 45 at both ends of the pump are subject to inlet pressure only.

Also, it will be seen that the present invention affords a novel pump of the aforementioned type which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A multi-stage regenerative turbine pump comprising:

a. an elongated segmented casing having (1) two segmented end sections each having an inlet opening for volatile liquids at each of the outer two opposite ends thereof for feeding liquid into said casing end sections and an outlet opening on the end opposite the outer two ends with passageway means communicating between said inlet and said outlet openings, and (2) a segmented intermediate section positioned between said segmented end sections, and defining an unobstructed interior chamber therein, said segmented intermediate section comprised of a discharge casing ring having a discharge opening communication with said interior chamber to provide unobstructed fluid flow therefrom and two annular transfer rings each having an opening on each side of said discharge casing ring aligned with said outlet openings on each of said end sections for communicating between said outlet openings on each of said end sections and said discharge opening, with said discharge opening of said discharge casing ring disposed substantially midway between said inlet openings for discharging the volatile liquid from said casing, b. an elongated drive shaft (1) extending through said elongated segmented casings in substantially longitudinal alignment therewith, and (2) rotatably mounted in said segmented casing, and c. an impeller means mounted on and operatively connected to said drive shaft adjacent each of said inlet openings in said end sections for rotation thereby in a plane parallel to the plane of the discharge opening in said intermediate section, upon rotation of said shaft in said casing, for feeding such volatile liquid into each of said end section casings through said inlet openings, and d. an equal number of at least one turbine impeller being disposed in each of said end sections in said segmented casing between said intermediate section and each of said inlet openings for pumping the volatile liquid through said passageway means and said openings in said intermediate section and into said interior chamber therein for discharging the volatile liquid from said casing through said discharge opening.

2. A multi-stage regenerative turbine pump as defined in claim 1 wherein an equal number of at least one turbine impeller includes a plurality of said turbine impellers disposed between said discharge opening and each of said inlet openings.

3. A multi-stage regenerative turbine pump as defined in claim 1 wherein said impeller means which is closest to each of said inlet openings on each respective end sections comprises a centrifugal booster impeller.

4. A multi-stage regenerative turbine pump as defined in claim 3 wherein each of said centrifugal booster impeller is in a respective stage in said casing which comprises a low N.P.S.H. booster stage.

5. A multi-stage centrifugal-regenerative turbine pump for pumping liquids at or near their boiling point and comprising:

a. an elongated segmented casing having (1) an intermediate casing section, and (2) two elongated end casing sections disposed on respective opposite sides of said intermediate sections and connected thereto, b. each of said end casing sections comprising a plurality of annular casing rings
(1) disposed in axial alignment with each other, and
(2) defining the outer housing for respective, individual stages of said pump, c. each of said stages including an impeller means rotatably mounted in said housing of said stage for pumping the volatile liquid through each of said stage during operative rotation of said impeller means in said housing, d. said intermediate casing section defining an unobstructed interior chamber therein comprising an intermediate casing ring having a discharge passageway opening communicating with said interior chamber to provide unobstructed fluid flow therefrom and extending substantially radially outwardly therethrough in a plane parallel to the plane of rotation of said impeller means and two annular transfer rings positioned on each side of said intermediate casing ring, with each transfer ring having openings therein on each side thereof communicating with each of said end casing sections and said intermediate casing ring and said interior chamber, and e. each of said end casing sections of said casing having an elongated passageway means, including the interiors of said casing rings,
(1) extending longitudinally therethrough,
(2) having an inlet opening outwardly through the end of said end section remote from said intermediate casing section, and
(3) having an outlet opening communicating with said two annular transfer rings and said intermediate casing ring, and f. means for rotating said impeller means for pumping the volatile liquid through said elongated passageways from said inlet openings and feeding said volatile liquid past said outlet opening and through said openings in said intermediate section and into said intermediate section and said interior chamber therein and outwardly therethrough said discharge passageway opening.

6. A multi-stage centrifugal-regenerative turbine pump as defined in claim 5, and in which a. said means for rotating said impellers comprises an elongated drive shaft
(1)extending longitudinally through said casing, and
(2) operatively connected to said impellers means.

7. A multi-stage centrifugal-regenerative turbine pump as defined in claim 6, and in which said casing rings are removably mounted relative to each other.

8. A multi-stage centrifugal-regenerative turbine pump as defined in claim 7 wherein said impeller means in each of said stages which is disposed immediately adjacent to one of said inlet openings comprises a centrifugal booster impeller.

9. A multi-stage centrifugal-regenerative turbine pump as defined in claim 8 wherein all of said impellers, other than said centrifugal booster impellers, comprise regenerative turbine impellers.

10. A multi-stage centrifugal-regenerative turbine pump as defined in claim 9 wherein each of said centrifugal booster impellers is in a respective one of said stages which comprises a low N.P.S.H. booster stage for pumping the volatile liquid at or near the boiling point thereof.

* * * * *

UNITED STATES PATENT AND TRADEMARK OFFICE

CERTIFICATE OF CORRECTION

PATENT NO. : 4,479,756

DATED : October 30, 1984

INVENTOR(S) : Leonard J. Sieghartner

It is certified that error appears in the above—identified patent and that said Letters Patent is hereby corrected as shown below:

Column 1, line 64, after "mode" insert --in--;

Signed and Sealed this

*Thirtieth* Day of *April 1985*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,479,756

DATED : October 30, 1984

INVENTOR(S) : Leonard J. Sieghartner

It is certified that error appears in the above—identified patent and that said Letters Patent is hereby corrected as shown below:

Column 3, line 35, delete "or", insert --of--.

Signed and Sealed this

*Twenty-fifth* Day of *June 1985*

[SEAL]

*Attest:*

DONALD J. QUIGG

*Attesting Officer* *Acting Commissioner of Patents and Trademarks*